US008882444B2

(12) United States Patent
Williams et al.

(10) Patent No.: US 8,882,444 B2
(45) Date of Patent: Nov. 11, 2014

(54) COMPRESSOR GAS FLOW DEFLECTOR AND COMPRESSOR INCORPORATING THE SAME

(75) Inventors: Carnell E. Williams, Southfield, MI (US); Timothy J. Johnson, Auburn Hills, MI (US); Tracy M. Farell, Grand Blanc, MI (US); Kulwinder Singh, Rochester Hills, MI (US); Gary J. Hazelton, White Lake, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 833 days.

(21) Appl. No.: 13/088,819

(22) Filed: Apr. 18, 2011

(65) Prior Publication Data

US 2011/0255952 A1 Oct. 20, 2011

Related U.S. Application Data

(60) Provisional application No. 61/325,472, filed on Apr. 19, 2010.

(51) Int. Cl.

| | |
|---|---|
| ***F04D 27/02*** | (2006.01) |
| ***F04D 29/44*** | (2006.01) |
| ***F04D 29/68*** | (2006.01) |

(52) U.S. Cl.

CPC ..... *F04D 29/441* (2013.01); *F04D 29/681* (2013.01)

USPC ..... 415/58.4

(58) Field of Classification Search

CPC ..... F04D 27/0207; F04D 27/0238; F04D 27/0215; F04D 27/02

USPC ..... 415/52.1, 58.2, 58.3, 58.4, 58.6, 56.1, 415/56.5, 144, 185

See application file for complete search history.

(56) References Cited

U.S. PATENT DOCUMENTS 2,865,297 A * 12/1958 Cliborn et al. ..... 415/58.4
4,743,161 A 5/1988 Fisher et al.

(Continued)

FOREIGN PATENT DOCUMENTS

| | | | |
|---|---|---|---|
| CN | 1070721 | A | 4/1993 |
| DE | 4027174 | A1 | 3/1992 |
| JP | 2003074360 | A | 3/2003 |
| JP | 2007127108 | A | 5/2007 |

OTHER PUBLICATIONS

Chinese Office Action dated Apr. 19, 2013 for Chinese Pat. App. for Invention No. 201110118702.6.

*Primary Examiner* — Richard Edgar
(74) *Attorney, Agent, or Firm* — Cantor Colburn LLP

(57) ABSTRACT

A turbocharger compressor includes a compressor housing having a housing wall that includes a shroud that defines a central air channel and a compressor inlet in fluid communication with the central channel and an inlet duct. It also includes a compressor wheel configured to draw air into the compressor inlet from the inlet duct and create a main airflow in the central air channel axially toward a compressor outlet. The compressor also includes a bypass channel that extends between an opening in the main channel located between the compressor inlet and compressor outlet proximate the compressor blades and the compressor inlet. The compressor also includes a deflector that includes a deflector surface that is configured to direct a bypass airflow in the bypass channel, and flowing in a direction from the main channel toward the compressor inlet, into the compressor inlet axially and radially inwardly toward the compressor wheel.

19 Claims, 9 Drawing Sheets

(56) References Cited

U.S. PATENT DOCUMENTS 5,333,990 A 8/1994 Foerster et al.
6,623,239 B2 9/2003 Sahay et al.
2009/0013689 A1 * 1/2009 Sumser et al. ..... 60/605.1

* cited by examiner

COMPRESSOR GAS FLOW DEFLECTOR AND COMPRESSOR INCORPORATING THE SAME

CROSS REFERENCE TO RELATED APPLICATIONS

This application claims priority to U.S. Provisional Patent Application Ser. No. 61/325,472 filed on Apr. 19, 2010, which is incorporated herein by reference in its entirety.

FIELD OF THE INVENTION

The subject invention relates to turbochargers for internal combustion engines, and more particularly to turbocharger compressors, and even more particularly to deflectors for directing compressor gas flows.

BACKGROUND

Turbochargers are used to increase the intake air pressure of internal combustion engines, and are increasingly being used to increase internal combustion engine output with lower engine displacements and improved fuel efficiency. A turbocharger includes a turbine wheel and a compressor wheel, generally mounted on a common shaft and disposed in separate housings. Engine exhaust is routed through the turbine where it drives a turbine wheel that generally includes an impeller having blades or vanes and is coupled, directly or indirectly, to a compressor wheel that also generally includes an impeller having blades or vanes. The compressor wheel draws in intake air, generally through a filtration system and into an inlet duct where it is drawn across the blades or vanes, compressed and supplied to the intake port or manifold of the engine. The compressor wheel spins at high rotational speeds, including speeds in the range of 100,000 to 150,000 revolutions per minute, or greater.

To increase compressor performance, bypass ports are added to the compressor inlet. These ports may be added in several forms, including as a ported shroud. A compressor without a bypass port generally has a single inlet to the compressor wheel that is defined by the compressor housing. A ported shroud bypass port provides a compressor inlet that has an inner and outer portion. A ported shroud bypass port compressor may have a housing similar to those of compressors that do not have a port, where the housing defines a compressor inlet and outlet, but it also has an additional outer wall separated from the (inner) inlet wall. In such configurations, the compressor wheel is mounted in a central portion of the compressor housing within the inner wall of the inlet and the bypass port is defined by an additional outer wall that forms a shroud around the inner wall of the compressor housing. The inner wall extends beyond the compressor wheel, but does not extend as far outwardly as the outer wall. The bypass portion of the inlet or bypass channel lies between the outer surface of the inner wall and the inner surface of the outer wall. The main or inner portion of the inlet includes a central channel, defined within the inner surface of the inner wall and provides a path to the face of the compressor wheel. The inner portion of the inlet also has a channel, or channels, defined between the main inlet and the inner surface of the inner wall, through the wall to the outer surface of the inner wall that fluidly connects the bypass portion of the inlet, and the bypass port. The annular channel(s) open into the inner surface of inner wall proximate the vanes or blades of the compressor wheel.

A bypass port increases the operating range of a compressor by expanding the extent of both its low mass flow range and the high mass flow range. The low mass flow range is limited by a phenomena referred to as "surge," where the volume of air provided to the compressor exceeds the system requirements, and is limited at high mass flow by a phenomena referred to as "choke," where the system's air requirements exceed the maximum flow rate of the compressor. The annular channel, or port, in communication with the compressor wheel acts as a bypass. At low mass flows, which would otherwise cause a surge condition without the bypass port, the presence of the bypass port allows flow back from the compressor wheel to the main inlet, thereby allowing the system to reach equilibrium at lowest mass flows. At high mass flows, which would otherwise cause a choke condition without the bypass port, the presence of the port allows extra air to be drawn directly into the bypass port from the main inlet and supplied to the blades of the compressor wheel. Due to the extended operational range, compressors configured with this type of inlet are sometimes known as "map width enhanced" compressors.

However, the use of a bypass port also increases the noise generated by the compressor, since the port provides a direct sound path to the compressor wheel, and thus provides a means for audible noise (sound waves) generated by the compressor wheel at high rotational speeds and mass flows or pressure ratios to exit the compressor housing. This high speed rotation of the turbine and compressor wheels causes the turbine and compressor blades to generate high levels of noise, known as Blade Pass Frequency noise, or sometimes informally referred to as turbo whine. One method of reducing this noise has been to place an annular inner deflector in the bypass port between the inner wall and outer wall that projects both orthogonally into the port and that extends axially along the port, thereby creating a "torturous" path for the air and sound waves to traverse. Another solution has been to add an annular noise suppressor ring to the inner surface of the outer wall that has an inner diameter that is less than the inner diameter of the bypass port, i.e., the outer diameter of the inner wall, in order to block line-of-sight transmissions of sound out of the annular channel comprising the bypass port.

While these features are effective to reduce noise associated with high speed rotation of the compressor under choke conditions, they were not designed, nor are they effective to, control gas flows within the bypass port particularly where these flows exit the bypass channel into the main inlet channel as occurs under surge conditions, i.e., low mass flow operation of the compressor.

Accordingly, it is desirable to control gas flow through the bypass port into the main compressor inlet and provide compressors and turbochargers having control features that provide such control.

SUMMARY OF THE INVENTION

In an exemplary embodiment, a compressor for a turbocharger is disclosed. The compressor includes a compressor housing, the compressor housing having a housing wall, the housing wall comprising a shroud having an inner wall that defines a central air channel of the compressor, the shroud defining a compressor inlet in fluid communication with the central channel. The compressor also includes an inlet duct that is sealingly disposed over the compressor inlet, the inlet duct comprising a duct air channel that is configured to provide air to the compressor inlet and main air channel. The compressor further includes a compressor wheel rotatably disposed within the shroud proximate the inner wall and attached to a driven shaft, the wheel comprising a plurality of circumferentially-spaced, axially-extending compressor blades that radially protrude from a hub, the blades configured to draw air into the compressor inlet from the inlet duct and create a main airflow in the central air channel axially toward a compressor outlet upon rotation of the wheel. Still further, the compressor includes a bypass channel that extends between an opening in the main channel located between the compressor inlet and compressor outlet proximate the compressor blades and the compressor inlet. Yet further, it includes a deflector comprising a deflector surface that is configured to direct a bypass airflow in the bypass channel, and flowing in a direction from the main channel toward the compressor inlet, into the compressor inlet axially and radially inwardly toward the compressor wheel.

In another exemplary embodiment, a collar configured for sealing disposition between an inlet duct and a compressor inlet of a turbocharger is disclosed. The collar includes a deflector having a deflector surface that is configured to direct a bypass airflow from a bypass channel, and flowing in a direction from a main channel of the compressor toward the compressor inlet, into the compressor inlet axially and radially inwardly toward a compressor wheel.

In yet another exemplary embodiment, an inlet duct configured for sealing disposition to a compressor inlet of a turbocharger is disclosed. The inlet duct includes a deflector having a deflector surface that is configured to direct a bypass airflow from a bypass channel, and flowing in a direction from a main channel of the compressor toward the compressor inlet, into the compressor inlet axially and radially inwardly toward a compressor wheel.

In yet a further exemplary embodiment, a method of operating a compressor of a turbocharger is disclosed. The method includes providing a compressor that has a bypass channel that extends between an opening in a main channel of the compressor located between the compressor inlet and compressor outlet proximate the compressor blades and the compressor. The method also includes providing a deflector comprising a deflector surface that is configured to direct a bypass airflow in the bypass channel, and flowing in a direction from the main channel toward the compressor inlet, into the compressor inlet axially and radially inwardly toward the compressor wheel. The method further includes operating the compressor in a surge condition to produce the bypass airflow, wherein the bypass airflow flows into the compressor inlet axially and radially inwardly toward the compressor wheel.

The above features and advantages and other features and advantages of the invention are readily apparent from the following detailed description of the invention when taken in connection with the accompanying drawings.

BRIEF DESCRIPTION OF THE DRAWINGS

Other objects, features, advantages and details appear, by way of example only, in the following detailed description of embodiments, the detailed description referring to the drawings in which.

DESCRIPTION OF THE EMBODIMENTS

Figure 1:
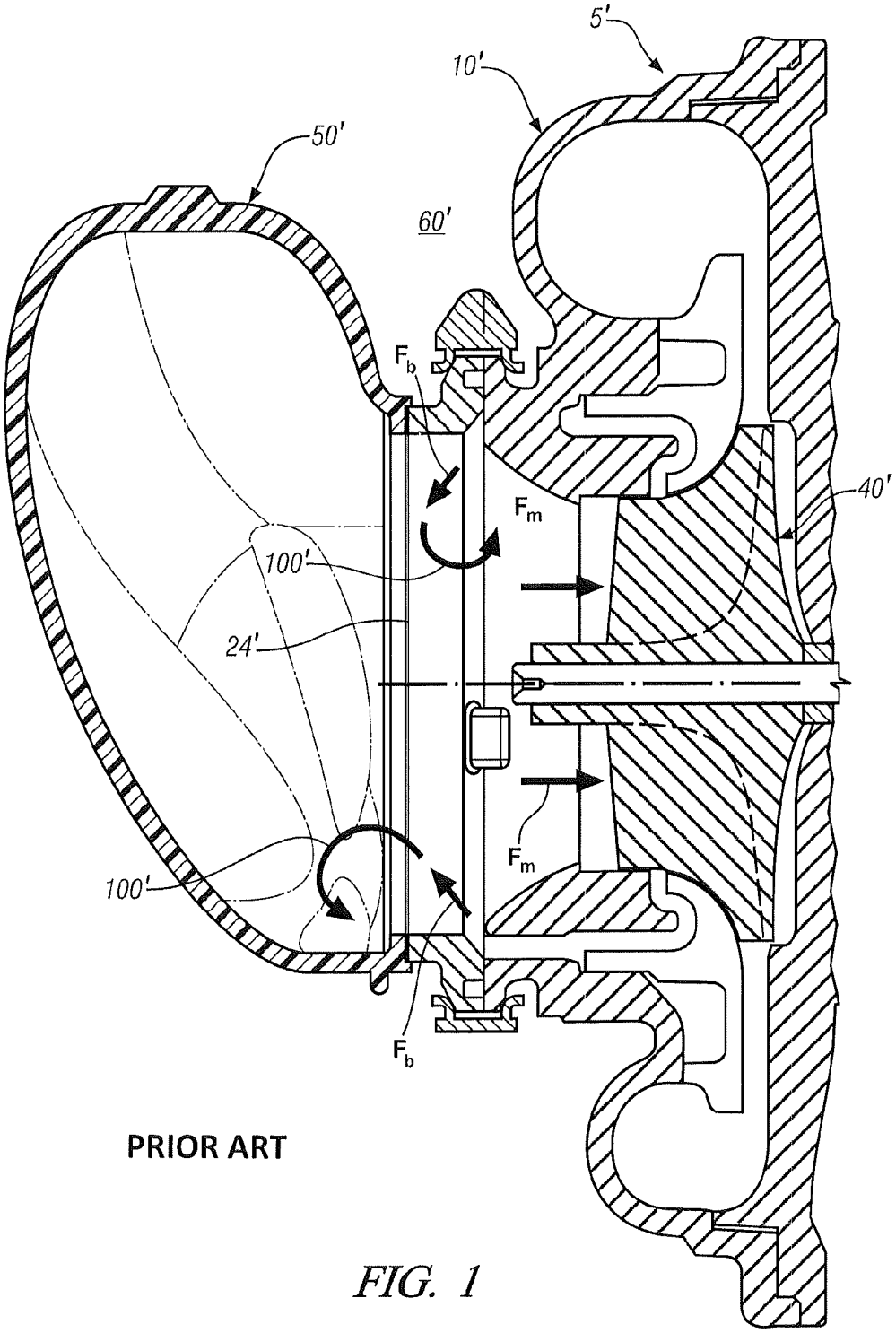
FIG. 1 is a cross-sectional view of a related art inlet duct that is fluidly coupled to a ported turbocharger, as described herein.

Referring to FIG. 1, under surge conditions, the surge bypass airflow $F_b$ that occurs when operating a bypass port compressor 10' attached to an inlet duct 50' may result in undesirable compressor 10' and turbocharger 5' performance, including undesirable noise, vibration, harshness (NVH) performance, as well as reduced turbocharger 5' efficiency. These are attributable to disturbance of the main airflow $F_m$ by the surge bypass airflow $F_b$ as it passes from the inlet duct 50' through the main inlet 24' into the compressor 10'.

The airflow patterns in the form of velocity vectors as a function of location within the inlet duct 50' that result without controlling the surge bypass airflow $F_b$ into the main airflow $F_m$ include one or more airflow disturbances 100' as described herein. Compressor intake airflows that result from the use of annular inner deflectors and annular noise suppressor rings as described herein that have been used to reduce noise under choke conditions also produce airflow disturbances 100' as described herein, since such features permit the surge bypass airflow $F_b$ to be directed into the main inlet 24' of the compressor 10' generally orthogonal to the main flow $F_m$, or even axially and radially away from the compressor wheel 40' and generally opposite to the main flow $F_m$. The resulting airflow disturbances 100' or disruptions include the creation of recirculating flows or vortexes or other localized airflow disruptions of the inlet pressure and flow direction or speed, or both, of main airflow $F_m$ at various locations within the inlet duct 50' or main inlet 24'. These airflow disruptions 100' limit, and more particularly restrict, the main flow $F_m$ into portions of the compressor inlet 24' that are effectively blocked by these disruptions, thereby reducing the overall efficiency of the compressor, and thus the overall efficiency, including fuel and performance efficiency, of the turbocharger and the engine that it is coupled to. As noted, they also may result in undesirable NVH conditions and performance. These performance limitations may be reduced or eliminated by controlling the surge bypass airflow $F_b$ and its interaction with the main airflow $F_m$ as disclosed herein.

Referring to FIGS. 2-9, exemplary embodiments of a turbocharger 5 having a bypass port or ported shroud compressor 10 are provided. The compressor 10 has a compressor housing 20, with an outer wall 22 defining main compressor inlet 24. The main compressor inlet 24 has an outer portion 26 and an inner portion 28. The outer portion 26 is generally defined by the outer wall 22 of the compressor housing 20. The outer wall 22 has an inner surface 30. The compressor housing 20 further defines a compressor outlet 32. Within the outer wall 22 of the compressor housing 20 is a shroud 34, defined by an inner compressor wall 36. The inner wall 36 has an inner surface 38, and an outer surface 39. In an exemplary embodiment, the outer wall 22 defined by the housing is cylindrical, and the shroud 34 is defined by a cylindrical inner wall 36 concentric with the outer wall 22.

Figure 2:
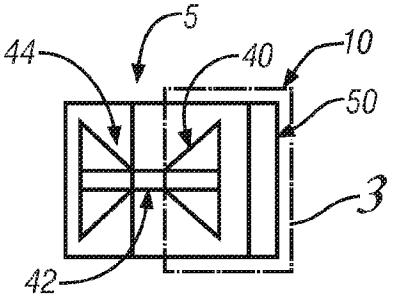
FIG. 2 is a schematic view of an exemplary embodiment of a deflector collar, bypass port compressor and turbocharger, having a bypass deflector as disclosed herein.

A compressor wheel 40 is rotatably mounted within the shroud 34 on a rotatable shaft 42 that is driven by the turbine wheel 44 (FIG. 2). In one embodiment, the compressor wheel 40 is comprised of a plurality of circumferentially spaced vanes 46 or blades that extend axially along and project or protrude radially from a hub 48. The compressor wheel 40 is located such that the inner surface 38 of the shroud 34 is adjacent to the blades 46 of the compressor wheel 40. The rotatable compressor wheel 40 is coupled to the rotatable shaft 42, which is coupled to the rotatable turbine wheel 44. As exhaust from an internal combustion engine (not shown) drives the turbine wheel 44, the rotational energy is translated through the shaft 42 to the compressor wheel 40. As the compressor wheel 40 turns, it draws air into the compressor 10 from the inlet duct 50 and across the blades 46 or vanes of the compressor wheel 40 where the rotational movement of the wheel coupled with the action of the blades on the airflow compresses the air thereby increasing or boosting the pressure and forcing the pressurized air out through the compressor outlet 32. The inlet duct 50 comprises a duct air channel that is configured to supply air 58 to the main compressor inlet 24.

The inner wall 36 of the shroud 34 defines a central channel 52 that is in fluid communication with the main compressor inlet 24 and the compressor outlet 32. An annular bypass channel 54 is defined between the outer surface 39 of the inner wall 36 and the inner surface 30 of the outer wall 22. The central channel 52 and the annular bypass channel 54 form the inner portion 28 of the main inlet 24. At least one port or bypass 56 runs through the inner wall 36, allowing communication between the annular bypass channel 54 and the blades 46 of the compressor wheel 40. In one exemplary embodiment, the port or bypass 56 may comprise a series of apertures through the inner wall 36. However, slots or other passage forms which allow flow through the inner wall 36 may also be used.

Air 58 enters the compressor through the outer portion 26 of the inlet 24. The air then passes through the central channel 52, into the compressor wheel 40, in the form of airflow $F_m$ and is forced to the outlet 32. In a low mass flow (surge side of compressor map) 60, when the volume of air 58 entering the compressor 10 exceeds the compressor's 10 requirements, air 58 also exits the compressor wheel 40 through the port 56, and flows as airflow $F_b$ through the annular bypass channel 54 back to the outer portion 26 of main inlet 24 where the airflow $F_b$ reenters the central channel 52, as illustrated generally in FIGS. 2-9. This bypass action allows the compressor 10 to reach an equilibrium state.

In a choke condition (not shown), where the compressor's 10 requirements exceed the volume of air 58 entering the compressor 10, the reverse occurs as compared to the airflow in a surge condition 60 and air 58 enters the compressor 10 through the outer portion 26 of the main inlet 24, where a portion passes through the central channel 52 and into the compressor wheel 40, and another portion passes through the annular bypass channel 54 and directly into the vanes 46 of the compressor wheel 40, with both portions then forced to the outlet 32. This bypass action allows greater airflow into the compressor wheel 40 and greater compressor 10 efficiency.

Referring to FIGS. 2-9, the surge bypass airflow $F_b$ and its interaction with the main airflow $F_m$ may be controlled by the incorporation of airflow deflector 70. Airflow deflector 70 is configured to control the direction or magnitude, or both, of airflow $F_b$ and its interaction with the main airflow $F_m$. Deflector tip 71 of deflector 70 may be placed lower (i.e., downstream) than the upper edge or tip 72 of the inner wall 36, such that the difference distance (d) is greater than or equal to zero, so that direction of the annular surge airflows $F_b$ from the annular bypass channel 54 into the main or central inlet channel 52 have a velocity vector having an acute flow angle ($\alpha$) that is directed radially and axially inwardly toward the compressor wheel 40, and preferably at a flow angle that is as close to the direction of the main airflow $F_m$ as possible, such as a flow angle of about 60 degrees. By this placement of the deflector tip 71, flow angles $\alpha$ that are zero degrees or less than 0 degrees, and that are directed across (e.g. perpendicular to) or into (e.g. at a negative flow angle $\alpha$) the main flow $F_m$ direction or away from the compressor wheel are avoided, thereby eliminating disturbance of the main flow $F_m$. Avoidance of the disturbance of $F_m$ avoids the airflow/pressure disturbances 100' described above, as well as the creation of noise associated with these disturbances, and improves the overall efficiency of the turbocharger 5 and engine (not shown) as described above. The optimum flow angles $\alpha$ may vary depending on the design of the compressor 10, shroud 34 and other factors; however, it is desirable that the surge bypass airflows $F_b$ are directed radially and axially inwardly toward the inner surface 38 of the inlet or turbine wheel 40 as described.

Figure 4:
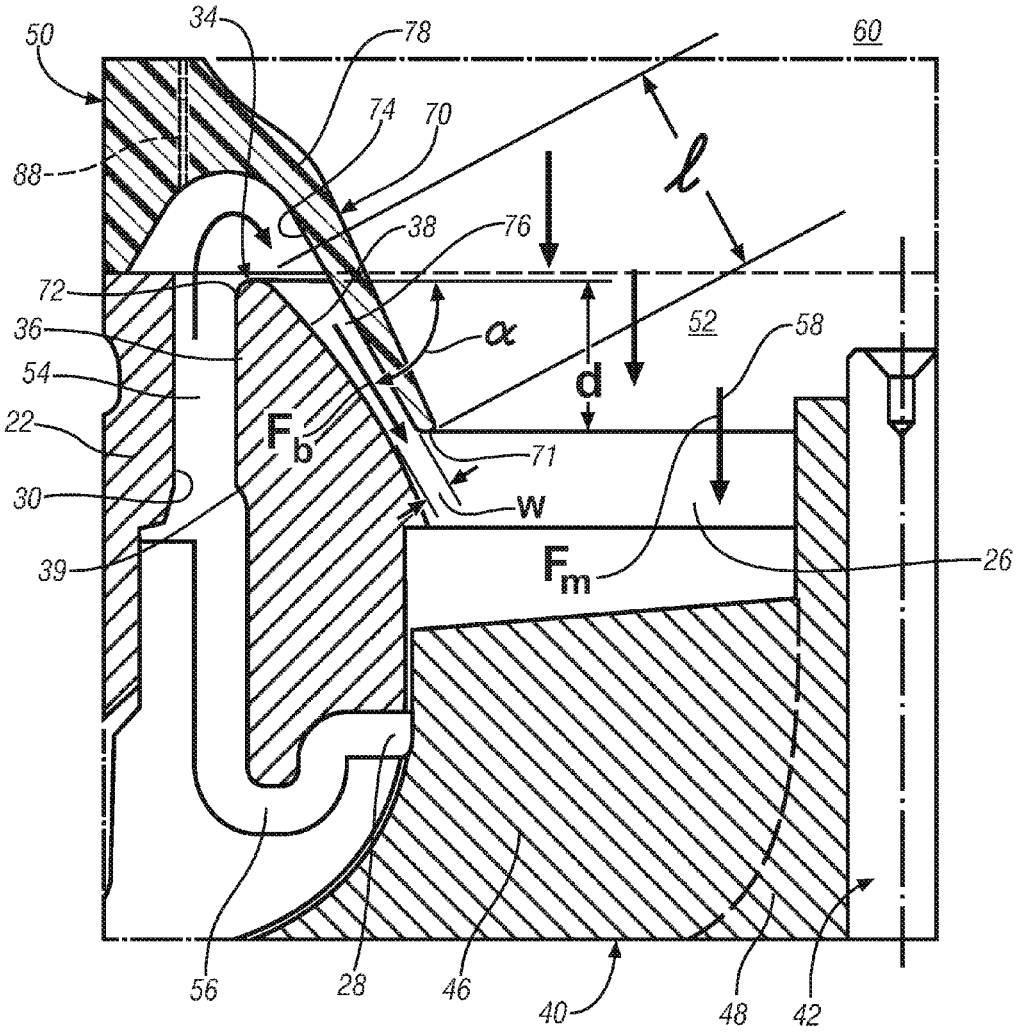
FIG. 4. is an enlarged cross-sectional view of region 4 of FIG. 3.
Figure 5:
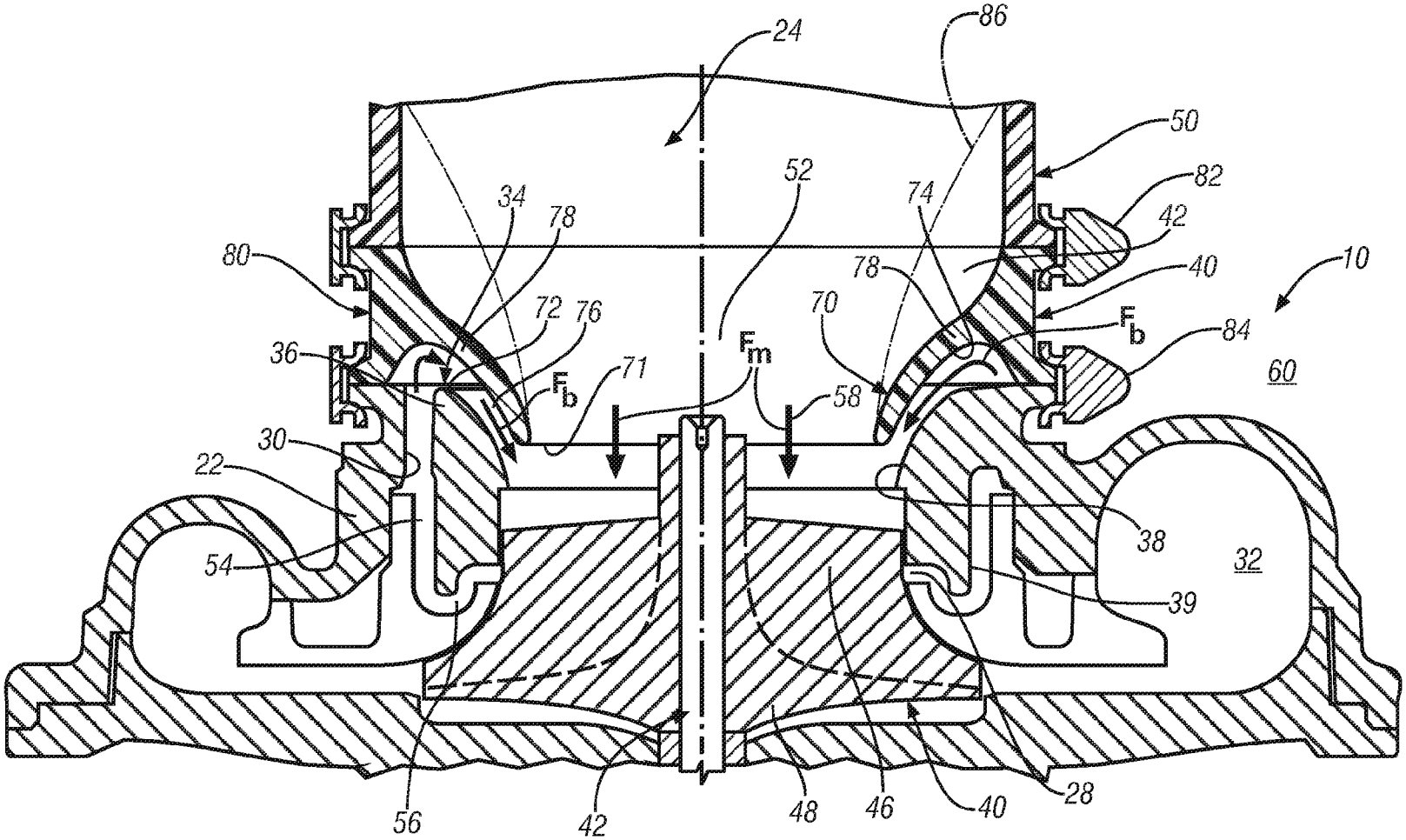
FIG. 5 is a cross-sectional view of a second exemplary embodiment of an inlet duct, flow deflector collar and a bypass port compressor and turbocharger, having a bypass deflector as disclosed herein.
Figure 6:
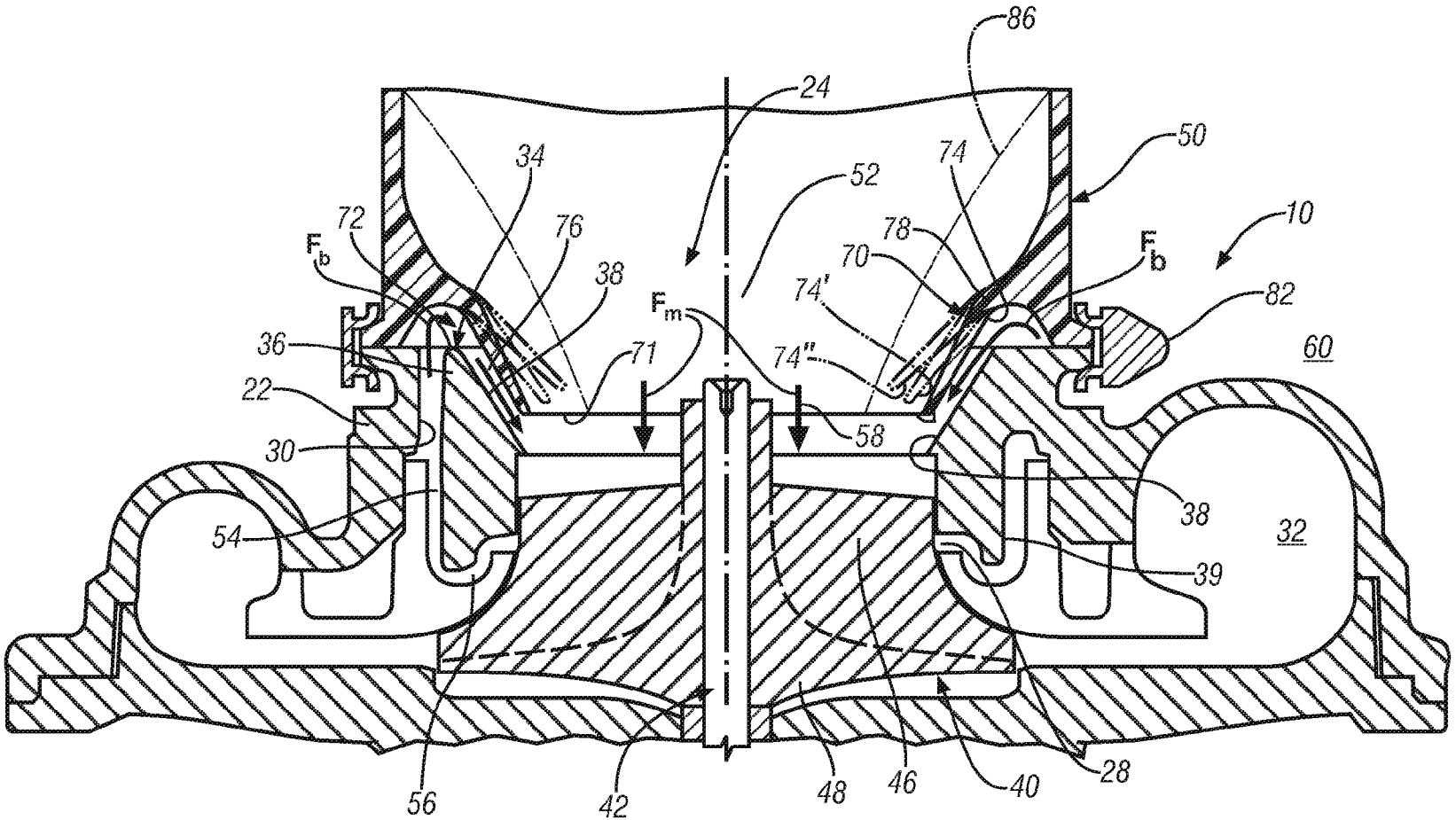
FIG. 6 is a cross-sectional view of a third exemplary embodiment of an inlet duct and a bypass port compressor and turbocharger, having a bypass deflector as disclosed herein.

Referring to FIGS. 2-9, in order to obtain the desired flow angle $\alpha$, it is desirable that the deflector 70 have a deflector surface 74 that extends radially inwardly and axially toward the compressor wheel and is opposed to the inner surface 38 of the inner wall 36. Deflector surface 74 and inner surface 38 define an outlet portion 76 of bypass channel 54 which channels bypass surge flow $F_b$ in the directions described above. Generally, the shape of deflector surface 74 will be selected to direct bypass surge flow $F_b$ inwardly toward the compressor wheel 40 as described above. Deflector surface 74 and inner surface 38 may have any suitable shapes which provide the desired direction of bypass surge flow $F_b$. For example, both may include flat planar or frustoconical surfaces (FIG. 6). As also shown in FIG. 6, in one exemplary embodiment deflector surface 74 may be directed inwardly toward inner surface 38 to define a converging outlet portion 76 that has a width that is converging or decreasing in the direction of bypass airflow $F_b$. In another exemplary embodiment, flat planar deflector surface 74' may be directed substantially parallel to flat planar inner surface 38 as shown in phantom in FIG. 6 to define a substantially uniform outlet portion 76 that has a substantially uniform width along its length. In yet another exemplary embodiment, flat planar deflector surface 74" may also be directed outwardly away from flat planar inner surface 38 to define a diverging outlet portion 76 that has a width that is diverging or increasing in the direction of bypass airflow $F_b$ as also shown in phantom in FIG. 6, so long as the axially and radially inward direction of bypass surge flow $F_b$ is maintained as described herein.

Figure 3:
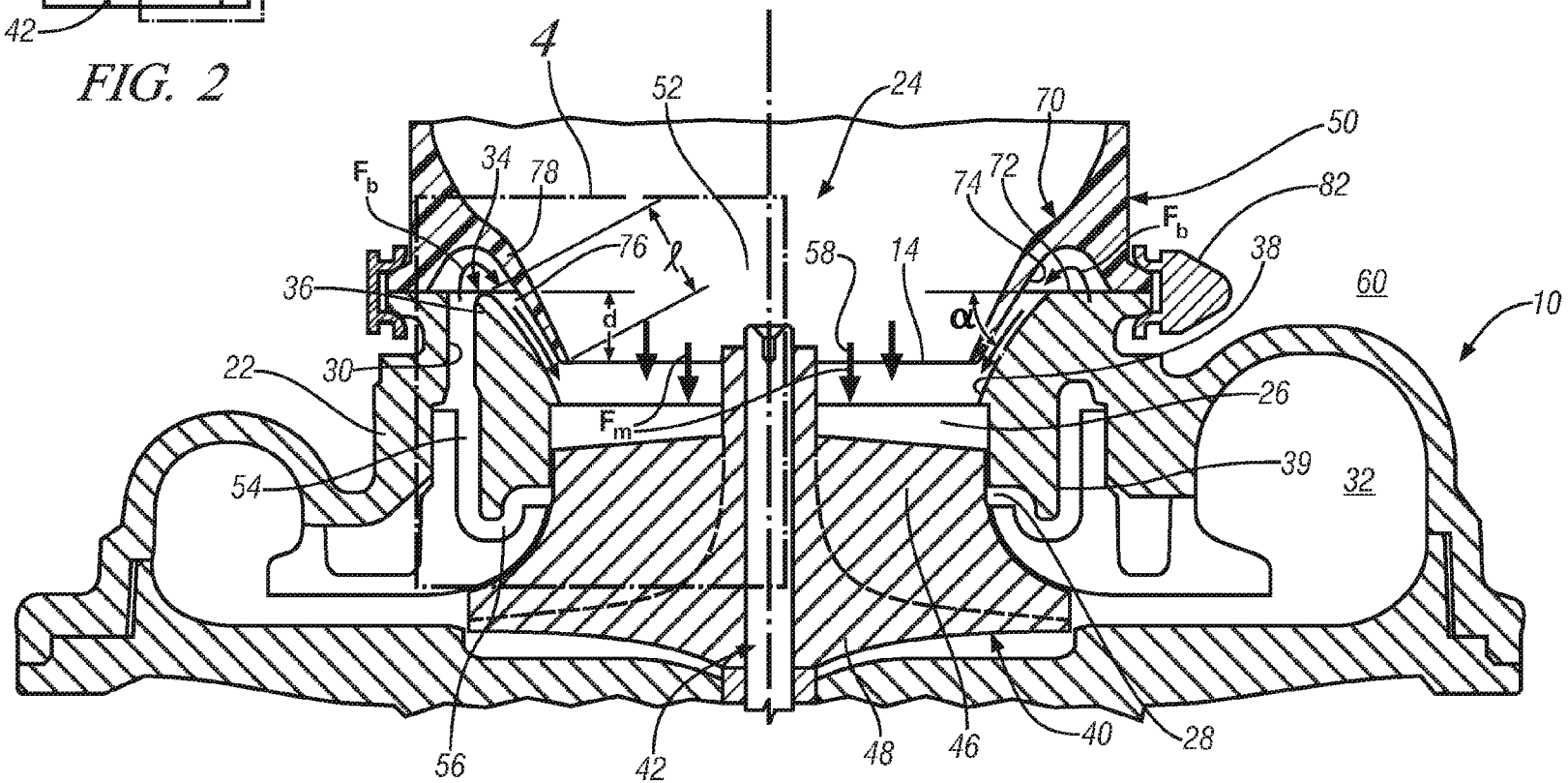
FIG. 3 is a cross-sectional view of the compressor and deflector collar of FIG. 2.

In other exemplary embodiments, one or both of deflector surface 74 or inner surface 38 may have a curved or arcuate shape as illustrated in FIG. 5, where both surfaces have an arcuate shape, or in FIG. 3 where only inner surface 38 has a curved shape and deflector surface 74 has a flat planar shape. Similarly, deflector surface 74 may have a lesser degree of curvature, the same degree of curvature or a greater degree of curvature as inner surface 38, such that it is sloping inwardly toward, parallel to or sloping outwardly away from inner surface 38, respectively. As will be appreciated, either of deflector surface 74 or inner surface 38 may also comprise a combination of flat planar and arcuate surface segments, in any combination, or other shapes, so long as the direction of bypass surge flow $F_b$ described herein is maintained in the outlet portion 76 of bypass channel 54. The optimum embodiment will be based not only on the specific design of the compressor stage, but also upon the geometric constraints imposed by packaging and other considerations.

The outlet portion 76 of bypass channel 54 may have any suitable shape as defined by the combination of deflector surface 74 or inner surface 38, so long as the direction of bypass surge flow $F_b$ is radially and axially inward into central channel 52 toward the compressor wheel 40. The opposing relation of deflector surface 74 to inner surface 38 defines outlet portion 76 of bypass channel 54 and provides outlet portion 76 with a length (l) and width (w) as illustrated in FIG. 4. In one exemplary embodiment, outlet portion 76 had a length of at least about 5 mm and a width of about 3 mm. These dimensions may be selected together with the shape and orientation of deflector surface 74 or inner surface 38 to ensure that a restriction is not created in the surge bypass airflow $F_b$ flow path that might lead to reduced effectiveness of the map width increasing features of the ported shroud, on either the low mass flow (surge) or high mass flow (choke) portions of operation. Further inappropriate selection of these geometric characteristics might also cause a reduction in compressor efficiency or overall turbocharger efficiency.

As illustrated in FIGS. 2-9, in exemplary embodiments, the deflector surface 74 of deflector 70 may comprise a surface of a radially and axially inwardly projecting arm 78. In the exemplary embodiment of FIG. 5, deflector surface 74 of deflector 70 may comprise a surface of a radially and axially inwardly projecting arm 78 of a deflector collar 80 that is configured to join the inlet duct 50 to compressor housing 60. Deflector collar 80 may be detachably and sealingly joined to inlet duct 50 and compressor housing 60 with suitable releasable connectors, such as v-clamps 82 and 84, respectively. Deflector collar 80 may be formed of any suitable material, including various metals, ceramics, engineering plastics or composite materials. In an exemplary embodiment, deflector collar 80 comprises a molded thermoplastic or thermoset material that is suitable for use at the operating temperature of the compressor housing, which may range from about 100° C. to about 250° C. Alternately, deflector surface 74 may be integrated into sidewall 86 of deflector collar 80 and/or inlet duct 50 as shown in phantom, rather than as a separate deflector arm 78, as shown in FIG. 5.

In the exemplary embodiment of FIG. 6, deflector surface 74 of deflector 70 may comprise a surface of a radially and axially inwardly projecting arm 78 that is integrally formed into and comprises an integral portion of inlet duct 50. Inlet duct 50 may be detachably and sealingly joined to compressor housing 60 by a suitable releasable connector, such as v-clamp 82. Inlet duct 50 may be formed of any suitable material, including various metals, ceramics, engineering plastics or composite materials, or a combination thereof. Alternately, deflector surface 74 may be integrated into sidewall 86 of inlet duct 50 as shown in phantom, rather than as a separate arm 78, as shown in FIG. 6.

Figure 7:
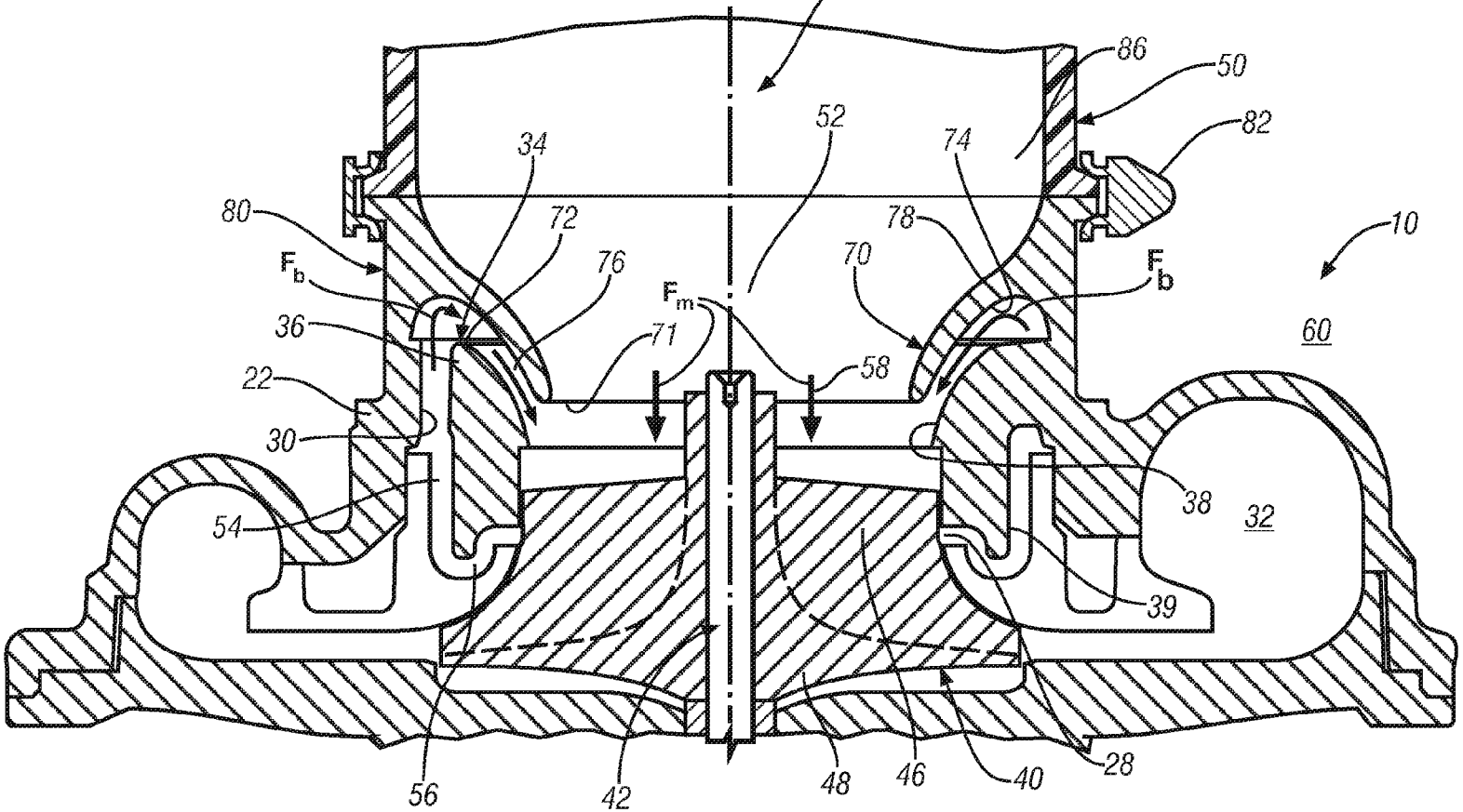
FIG. 7 is a cross-sectional view of a fourth exemplary embodiment of an inlet duct and a bypass port compressor and turbocharger, having a bypass deflector as disclosed herein.

In the exemplary embodiment of FIG. 7, deflector surface 74 of deflector 70 may comprise a surface of a radially and axially inwardly projecting arm 78 that is integrally formed into compressor housing 60. Compressor housing 60 and deflector 70 may be formed such that inlet duct 50 may be detachably and sealingly joined to compressor housing 60 proximate deflector 70 by a suitable releasable connector, such as v-clamp 82. Inlet duct 50 may be formed of any suitable material, including various metals, ceramics, engineering plastics or composite materials, or a combination thereof. Deflector 70 may be integrally formed into compressor housing 60 by casting this feature into the housing.

Figure 8:
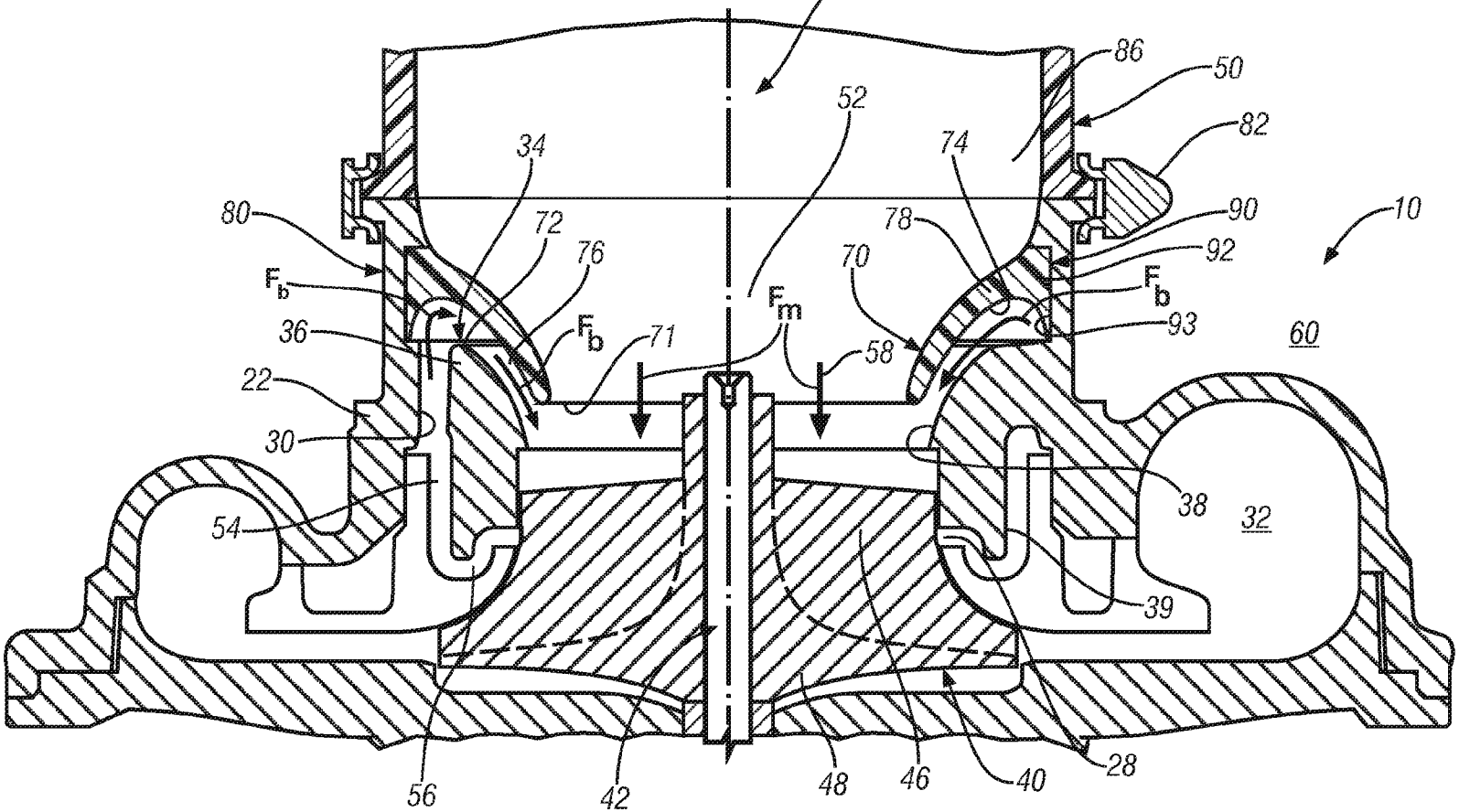
FIG. 8 is a cross-sectional view of a fifth exemplary embodiment of an inlet duct and a bypass port compressor and turbocharger, having a bypass deflector as disclosed herein.

In the exemplary embodiment of FIG. 8, deflector surface 74 of deflector 70 may comprise a surface of a radially and axially inwardly projecting arm 78 that is formed as a separate deflector insert 90, such as a metal deflector insert 92, that is configured to be disposed in the compressor inlet 52 of housing 60 proximate the bypass channel 54. Radially and axially inwardly projecting arm 78 may also comprise a tapered or frustoconical cylinder having a circular cross-sectional shape and a circumference. Deflector insert 90 may be adapted for an interference fit within a slot 93 formed within the outer wall 22. Alternately, deflector insert 90 may also include a spring bias member (not shown) to dispose deflector insert 90 proximate the bypass channel 54 and compressor inlet 52. Still alternately, deflector insert 90 may be disposed as described above by welding. Compressor housing 60 and deflector 70 may be formed such that inlet duct 50 may be detachably and sealingly joined to compressor housing 60 proximate deflector 70 by a suitable releasable connector, such as v-clamp 82. Deflector insert 90 and inlet duct 50 may be formed of any suitable material, including various metals, ceramics, engineering plastics or composite materials, or a combination thereof.

Figure 9:
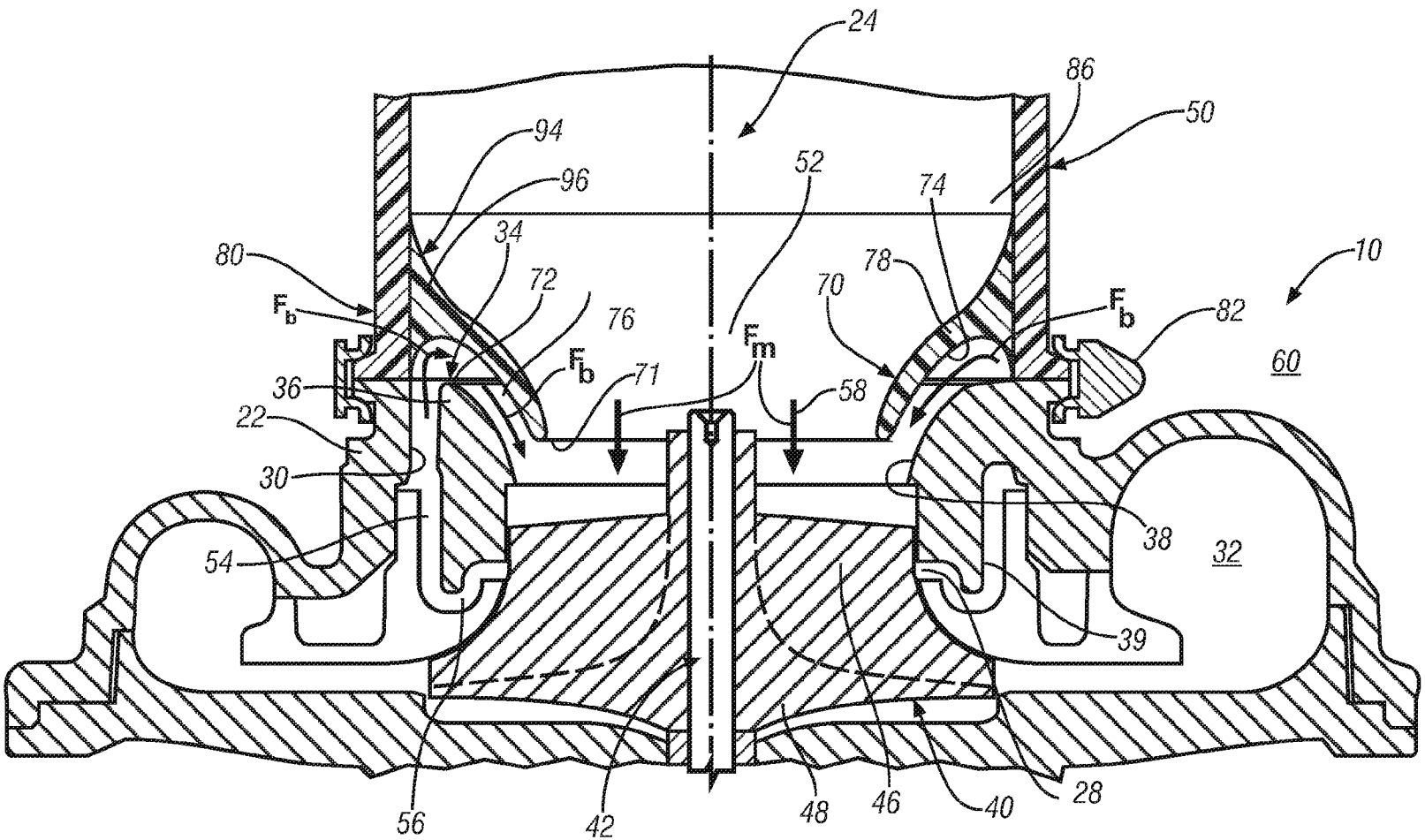
FIG. 9 is a cross-sectional view of a sixth exemplary embodiment of an inlet duct and a bypass port compressor and turbocharger, having a bypass deflector as disclosed herein.
Figure 10A:
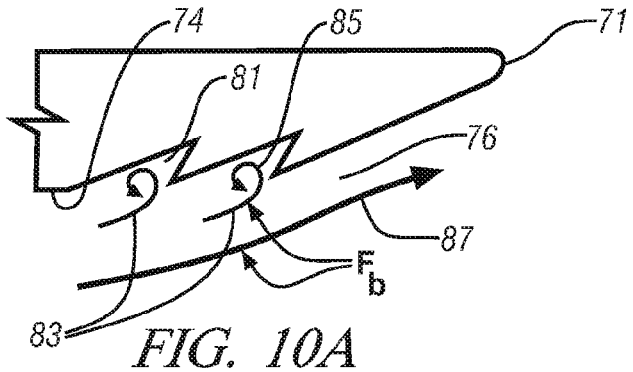
FIGS. 10A-10D each illustrate a cross-sectional profile of peripherally extending grooves disposed in a deflector arm and deflector surface.
Figure 10B:
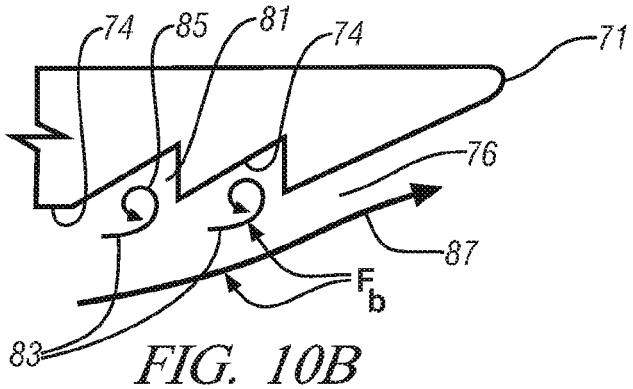
Figure 10C:
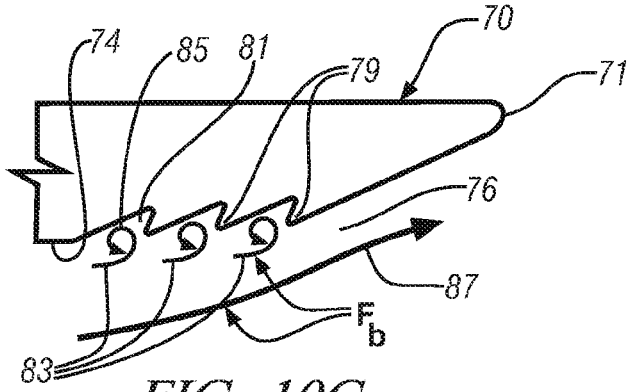
Figure 10D:
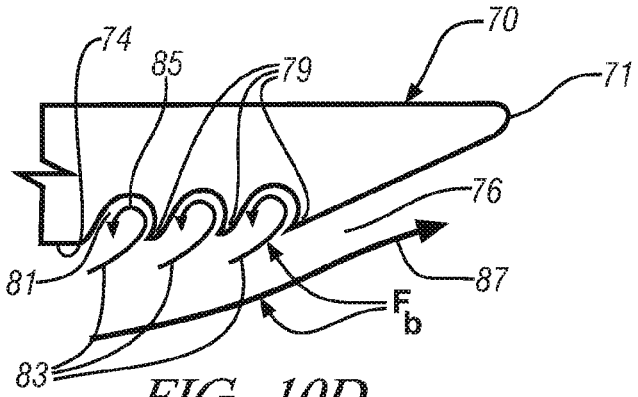

In the exemplary embodiment of FIG. 9, deflector surface 74 of deflector 70 may comprise a surface of a radially and axially inwardly projecting arm 78 that is formed as a deflector insert 94 disposed in a separate deflector collar 80 or inlet duct 50, such as a plastic deflector insert 96, that is configured to be disposed within one of deflector collar 40 or inlet duct 50 proximate the bypass channel 54. Deflector insert 94 may be disposed as described above by any suitable attachment mechanism. Deflector insert 94 may be adapted for an interference fit within these locations, including within a slot (not shown) formed within the outer wall 22. Alternately, deflector insert 94 may also be bonded in these locations by a suitable adhesive material (not shown) or by using various fasteners, such as various forms of threaded or snap-fit fasteners, or using a combination thereof. Compressor housing 60 and deflector 70 may be formed such that a deflector collar 80 insert or inlet duct 50 to which deflector is attached may be detachably and sealingly joined to compressor housing 60 proximate deflector 70 by a suitable releasable connector, such as v-clamp 82. Deflector insert 94 and deflector collar 80 or inlet duct 50 may be formed of any suitable material, including various metals, ceramics, engineering plastics or composite materials, or a combination thereof.

The various embodiments of deflector 70 provide great flexibility in its incorporation into a wide variety of inlet duct 50 and turbocharger 5 and compressor 10 designs, including newly designed combinations as well as well as existing designs that have already been manufactured and are currently in use. For example, a newly designed turbocharger 5 and compressor 10 and inlet duct 50 can be designed using a computational fluid dynamics (CFD) model of these components and their associated airflows to incorporate a deflector 70 that reduces or eliminates flow disturbances 100' to a predetermined level, preferably so that they are eliminated. The deflector 70 may then be incorporated into the casting of the compressor housing 60 to minimize the cost associated with this feature. Alternately, to maintain design flexibility, in a newly designed turbocharger 5 and inlet duct 50, deflector 70 may be incorporated into a deflector collar 40, or as a deflector insert 90, or as a deflector insert 94, as described herein. Incorporation of deflector 70 in one of these ways enables relatively easy and inexpensive changes to the design of the deflector 70 throughout the design life of a particular combination of turbocharger 5/compressor 10 and inlet duct 50. Incorporation of deflector 70 as deflector collar 40, or as a deflector insert 90, or as a deflector insert 94, as described herein, also enables the use of the deflector 70 in turbocharger 5/compressor 10 and inlet duct 50 designs that have been previously manufactured without a deflector. For example, a previously designed and manufactured bypass port turbocharger 5/compressor 10 and inlet duct 50 can be modeled using a CFD model to evaluate the benefits of incorporating a deflector 70 that reduces or eliminates flow disturbances 100' that exist in the design without the deflector to a predetermined level, preferably so that they are eliminated. In automotive applications, deflector 70 may be used in a wide variety of original equipment manufacture (OEM) and aftermarket applications.

Deflector 70, whether in the form of radially and axially inwardly projecting arm 78 or as sidewall 86, may extend circumferentially around bypass channel 54 as described herein either completely or partially. Deflector 70 may also include one or more small orifices 88 (e.g., FIG. 4) that may extend through radially and axially inwardly projecting arm 78 or sidewall 86 so that the deflector 70 not only acts to deflect all or some portion of surge bypass flow $F_b$ but also to diffuse a portion of the surge bypass flow or choke bypass flow (which flows in the opposite direction into the bypass channel 54) through these structures into the main inlet 24.

Deflector surface 74 or inner surface 38, or both of them, may be configured to alter bypass surge flow $F_b$ in the bypass channel 54, and particularly within the outlet portion 76. This includes the addition of features to alter the resistance of bypass surge flow $F_b$ through them, including reducing the resistance of bypass surge flow $F_b$ within outlet portion 76. In one exemplary embodiment, deflector surface 74 may be configured to include one or more peripherally extending grooves 81. The grooves 81 may have any suitable groove shape and size, including various frustoconical (FIGS. 10A and 10B) and arcuate or curved (FIGS. 10C and 10D) groove shapes. Grooves 81 may also be circular grooves and extend circumferentially in a spaced arrangement around deflector surface 74. Without being limited by theory, the grooves may cause the surface portion 83 of the bypass surge flow $F_b$ to swirl along the deflector surface 74 creating vortices 85 or eddy currents that reduce the drag of the main portion 87 of bypass surge flow $F_b$ as it passes through the outlet portion 76 as depicted in FIGS. 10A-10D.

The incorporation of deflector 74 is effective to reduce the Blade Pass Frequency noise, or turbo whine noise, generated by the compressor 10 due to the presence of bypass port 56 and the direct sound path from the compressor wheel 40 under all speed and load conditions of the compressor 10 and turbocharger 5. The deflector 74 may be designed to provide Blade Pass Frequency noise reduction over a predetermined frequency spectrum. In an exemplary embodiment, the deflector 74 is effective at reducing noise generated in a predetermined frequency spectrum of about 400 to about 4000 hz. In another exemplary embodiment, the deflector 74 is effective at reducing noise generated in a predetermined frequency spectrum of about 400 to about 1700 hz.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope of the present application.

What is claimed is:

1. A compressor for a turbocharger, comprising:

a compressor housing, the compressor housing having a housing wall, the housing wall comprising a shroud having an inner wall that defines a central air channel of the compressor, the shroud defining a compressor inlet in fluid communication with the central channel;

an inlet duct that is sealingly disposed over the compressor inlet, the inlet duct comprising a duct air channel that is configured to provide air to the compressor inlet and main air channel;

a compressor wheel rotatably disposed within the shroud proximate the inner wall and attached to a driven shaft, the wheel comprising a plurality of circumferentially-spaced, axially-extending compressor blades that radially protrude from a hub, the blades configured to draw air into the compressor inlet from the inlet duct and create a main airflow in the central air channel axially toward a compressor outlet upon rotation of the wheel;

a bypass channel that extends between an opening in the main channel located between the compressor inlet and compressor outlet proximate the compressor blades and the compressor inlet; and a deflector comprising a deflector surface that is configured to direct a bypass airflow in the bypass channel, and flowing in a direction from the main channel toward the compressor inlet, into the compressor inlet axially and radially inwardly toward the compressor wheel, wherein a peripherally extending groove is formed in the deflector surface.

2. The compressor of claim 1, wherein the deflector surface is disposed proximate an inner surface of the shroud to define an outlet portion of the bypass channel.

3. The compressor of claim 2, wherein the outlet portion of the bypass channel has a width that is one of converging, diverging or substantially uniform in the direction of the bypass airflow.

4. The compressor of claim 2, wherein at least one of the inner surface of the shroud and the deflector surface are one of arcuate or straight.

5. The compressor of claim 1, wherein the deflector comprises a deflector arm that extends axially and radially inwardly toward the compressor wheel.

6. The compressor of claim 1, wherein the deflector is disposed on the inlet duct.

7. The compressor of claim 6, wherein the deflector comprises an integral portion of the inlet duct.

8. The compressor of claim 6, wherein the deflector comprises an insert that is disposed on the inlet duct.

9. The compressor of claim 1, wherein the deflector is disposed on the compressor housing.

10. The compressor of claim 9, wherein the deflector comprises an integral portion of the compressor housing.

11. The compressor of claim 9, wherein the deflector comprises an insert that is disposed on the compressor housing.

12. The compressor of claim 1, further comprising a collar sealingly disposed between the compressor inlet and the inlet duct, wherein the deflector is disposed on the collar.

13. The compressor of claim 2, wherein a plurality of peripherally extending grooves is formed in the deflector surface.

14. The compressor of claim 1, wherein a plurality of circumferentially extending grooves is formed in the deflector surface.

15. The compressor of claim 14, wherein at least one of the peripherally extending groove and the circumferentially extending grooves has a groove profile that is arcuate or frustoconical, or a combination thereof.

16. The compressor of claim 15, wherein the deflector comprises a deflector arm that extends axially and radially inwardly toward the compressor wheel and the grooves are disposed proximate a tip of the deflector arm.

17. A collar configured for sealing disposition between an inlet duct and a compressor inlet of a turbocharger, the collar comprising a deflector having a deflector surface that is configured to direct a bypass airflow from a bypass channel, and flowing in a direction from a main channel of the compressor toward the compressor inlet, into the compressor inlet axially and radially inwardly toward a compressor wheel, wherein a peripherally extending groove is formed in the deflector surface, wherein the deflector is incorporated into the collar.

18. An inlet duct configured for sealing disposition to a compressor inlet of a turbocharger, the inlet duct comprising a deflector having a deflector surface that is configured to direct a bypass airflow from a bypass channel, and flowing in a direction from a main channel of the compressor toward the compressor inlet, into the compressor inlet axially and radially inwardly toward a compressor wheel, wherein a peripherally extending groove is formed in the deflector surface.

19. A method of operating a compressor of a turbocharger, comprising:

providing a compressor that has a bypass channel that extends between an opening in a main channel of the compressor located between the compressor inlet and compressor outlet proximate the compressor blades and the compressor;

providing a deflector comprising a deflector surface that is configured to direct a bypass airflow in the bypass channel, and flowing in a direction from the main channel toward the compressor inlet, into the compressor inlet axially and radially inwardly toward the compressor wheel, wherein a peripherally extending groove is formed in the deflector surface; and operating the compressor in a surge condition to produce the bypass airflow, wherein the bypass airflow flows into the compressor inlet axially and radially inwardly toward the compressor wheel.

* * * * *